United States Patent [19]

Althaus et al.

[11] Patent Number: 5,031,319

[45] Date of Patent: Jul. 16, 1991

[54] WET RAZOR

[75] Inventors: Wolfgang Althaus, Wuppertal, Fed. Rep. of Germany; Kenneth Grange, London, United Kingdom

[73] Assignee: Wilkinson Sword Gesellschaft mit beschränkter Haftung, Wuppertal, Fed. Rep. of Germany

[21] Appl. No.: 586,761

[22] Filed: Sep. 21, 1990

[30] Foreign Application Priority Data

Sep. 22, 1989 [DE] Fed. Rep. of Germany ..... 8911280

[51] Int. Cl.[5] ..... B26B 21/14

[52] U.S. Cl. ..... 30/85

[58] Field of Search ..... 30/83–90, 30/340; D28/48; 16/110 R

[56] References Cited

U.S. PATENT DOCUMENTS 1,791,553 2/1931 Bigomey ..... 30/85

4,949,457 8/1990 Burout ..... 30/85

FOREIGN PATENT DOCUMENTS 80348 9/1972 Fed. Rep. of Germany .

0277034 1/1977 Fed. Rep. of Germany .

*Primary Examiner*—Douglas D. Watts

*Attorney, Agent, or Firm*—Robert W. Becker & Associates

[57] ABSTRACT

A wet razor having a handle, at the front end of which a razor blade unit is disposed on a razor head, is provided. The handle has a central longitudinal plane that, starting from the razor head, has an essentially S-shaped curved configuration. The rear end of the handle is provided with a tongue-like widened portion. To improve the ergonomic properties of the razor, on the longitudinal underside of the handle 1 the tongue-like widened portion has a flattened portion.

9 Claims, 3 Drawing Sheets

WET RAZOR

BACKGROUND OF THE INVENTION

The present invention relates to a wet or safety razor having a handle, at the front end of which a razor blade unit is disposed on a razor head, with the handle having a central longitudinal plane that has an essentially S-shaped curved configuration, whereby the rear end of the handle is provided with a tongue-like widened portion. A razor blade unit refers to a plastic body in which a single or double razor blade is fixedly embedded.

Several types of wet razors are known that comprise a handle, at the front end of which a razor blade unit is disposed on a razor head via an appropriate securement mechanism. One special type of such razor is known from DE-GM 72 18 1O4 where to improve the ergonomic properties, the central longitudinal plane of the handle, starting from the razor head, has an essentially S-shaped curved configuration. Furthermore, the rear end of the handle is provided with a tongue-like widened portion. In contrast to wet razors where the handle is in the form of a straight rod, this curved handle has a better ergonomic shape. Unfortunately, with the heretofore known wet razor, the rear, tongue-like widened portion of the handle is large and bulky and is thus disruptive to the user, since an optimum ergonomic grasping of this tongue-like widened portion is still not ensured. In particular, the finger tips cannot find a good hold, which adversely affects guidance of the razor and hence an optimum shaving result.

A drawback of the razors known up till now is that they permit the user to grasp the handle in any desired manner. Thus, an optimum guidance of the razor while shaving is not ensured. The individual manner of holding the handle permits too great of a degree of freedom while grasping and positioning the razor, so that the user generally does not manage to obtain the optimum shaving angle while shaving. Thus, for example in particular with razor handles that have a cylindrical or essentially square cross-sectional configuration, the correct position of the blade relative to the surface that is to be shaved is not provided when the razor is grasped. Even the conventional pivothead razors permit a pivoting of the razor blade, and hence an adaptation to the contour of the face, only in the vertical direction (horizontal pivot axis). However, for an optimum shaving result, the correct position or shaving angle of the razor blade in the horizontal direction (vertical pivot axis) is also important.

It is therefore an object of the present invention to further improve the ergonomic characteristics of the handle of a wet razor of the aforementioned general type and to ensure a clearly-defined, optimum positioning of the razor or razor blade unit relative to the surface or skin that is to be shaved.

BRIEF DESCRIPTION OF THE DRAWINGS

This object, and other objects and advantages of the present invention, will appear more clearly from the following specification in conjunction with the accompanying schematic drawings, in which:

FIG. 1O is a cross-sectional view taken along the line X—X in FIG. 7.

SUMMARY OF THE INVENTION

Figure 1:
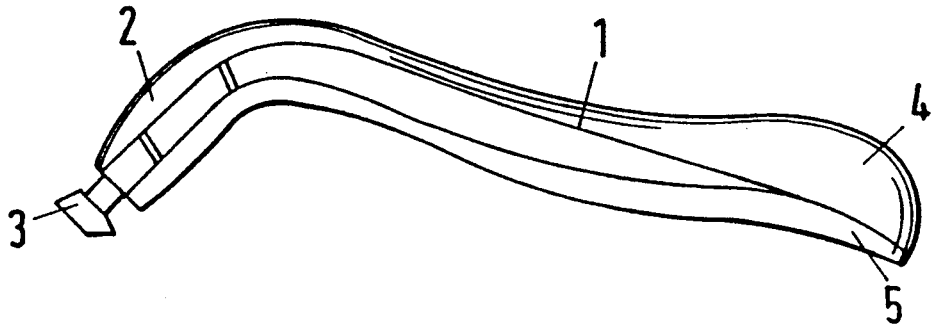
FIG. 1 is a side view of a first exemplary embodiment of the inventive wet razor.

The wet razor of the present invention is characterized primarily in that in the region of the handle between the razor head and the widened portion thereof, the handle has sides having a contour with a concave cross-sectional configuration, while upper and lower surfaces of the handle, 90° from the sides thereof, have a contour with a convex cross-sectional configuration. The concavely inwardly curved side surfaces of the handle preferably form an elongated ergonomic gripping recess or indentation for the thumb and middle finger of the user, so that a larger gripping surface for the fingers is ensured by the large surface support of the convexly curved rounded finger ends on the handle. A reliable grip is ensured even if the fingers are moist or the razor is covered with shaving cream or the like. Thus it is possible for the user to hold the razor in an extremely easy manner in the correct position for setting the optimum shaving angle for the surface that is to be shaved.

Pursuant to one expedient specific embodiment of the present invention, on the longitudinal underside of the handle the tongue-like widened portion is provided with a flattened portion. As a result of this flattened portion on the underside of the tongue-like widened portion, the ergonomic properties of the handle are further improved, since the finger tips that grasp the handle come to rest in this flattened portion. And it is precisely the finger tips that are responsible for an optimum guidance of the razor, so that by means of this inventive proposal, the objective of obtaining an optimum shaving result is met.

Pursuant to a further embodiment of the inventive razor, it is proposed that in the region between the forward razor head and the rear, tongue-like widened portion, the handle be provided on each side with a respective lateral widened portion that extends transverse to the longitudinal central axis of the handle, whereby between these lateral widened portions and the rear, tongue-like widened portion, gripping recesses or indentations be formed on the handle. A wet razor that is embodied in this manner is characterized by a handle that has optimum ergonomic properties that ensure a simple and reliable handling of the razor accompanied by an optimum shaving result.

Pursuant to one preferred specific embodiment of the present invention, the flattened portion of the tongue-like widened portion has at least one padding means of flexible material, with the surface of the padding means being essentially flush with the surface of the flattened portion. Such padding means have the advantage that during use of the razor, the finger tips come to rest upon these padding means, thereby improving the holding characteristics of the handle. The padding means comprise a soft, flexible material, so that the finger tips dig into this material in the same way that they would fit into a recess or indentation. Any material can be used for the padding means that would fulfill the requirements set thereof. For example, such material can be sponge rubber, foamed synthetic material, etc. The padding means can be a separate component that is inserted into the handle or is held therein in an interlocking manner.

Pursuant to one specific embodiment of the inventive razor, two padding means are provided that in the longitudinal direction of the handle are disposed one behind the other, with the padding means that is disposed closer to the razor head being smaller than the other padding means. These two padding means form the grasping surfaces for the finger tips of the small finger and the ring finger, so that with these fingers it is possible to have an optimum guidance of the razor while shaving.

The padding means are preferably round in order in this manner to provide an optimum grasping surface for the finger tips.

To facilitate manufacture of the handle, the handle preferably comprises two interconnecting molded parts that form an upper portion and a lower portion of the handle. These two molded parts are in particular in the form of half shells, and can be interlocked or can be interconnected via a frictional connection. In the latter case, one of the molded parts has pins formed thereon that during assembly of the handle engage in corresponding holes in the other molded part.

It is finally proposed in a further specific embodiment of the inventive razor that the center of gravitY thereof be disposed in a zone that is between one third and one half of the way from the front of the handle, in other words, that the center of gravity be disposed in the vicinity of where the thumb, index, and middle fingers rest. Thus, the center of gravity is disposed in the vicinity where the user grasps the handle with the thumb, middle, and index fingers, so that the razor is balanced in this grasping zone. This provides for a further improvement of the shaving result via an optimum handling of the handle. An on the whole large-volume configuration in the tongue region serves for supporting the curved hand and thumb surface, with the symmetrical configuration of the razor permits use with either the right or the left hand.

Further specific features of the present invention will be described in detail subsequently.

DESCRIPTION OF PREFERRED EMBODIMENTS

Referring now to the drawings in detail, each of the three illustrated wet razor embodiments is provided with a one-piece plastic handle 1, at the front end of which a razor blade unit 3 is disposed in a conventional manner on a razor head 2. The razor blade unit 3 comprises a single or double razor blade fixedly embedded in a plastic body.

Figure 2:
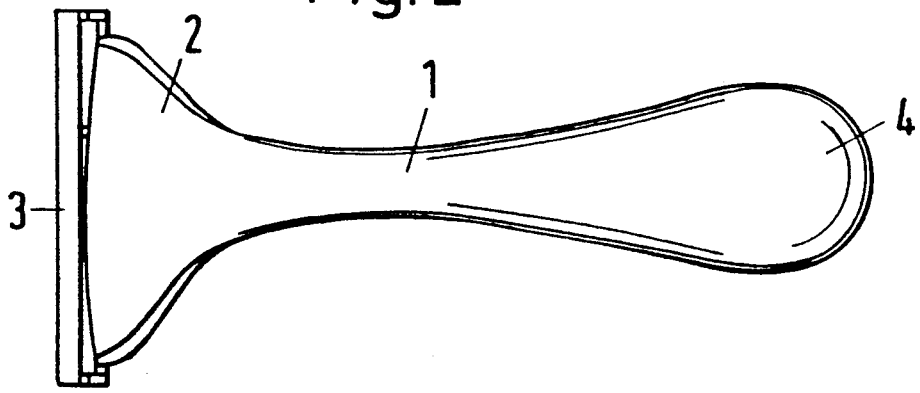
FIG. 2 is a top view of the razor of FIG. 1.

The first wet razor embodiment illustrated in FIGS. 1 and 2 comprises a handle 1, the longitudinal central plane of which, starting from the razor head 2, has an essentially S-shaped curved configuration. The rear end of the handle 1 is provided with a tongue-like widened portion 4 from where the handle 1 tapers in a necked-down manner in a direction toward the razor head 2. On the longitudinal underside of the handle 1, the tongue-like widened portion 4 is provided with a flattened portion 5, whereas on the longitudinal top side of the handle 1, the widened portion 4 has an essentially spherical shape.

Figure 3:
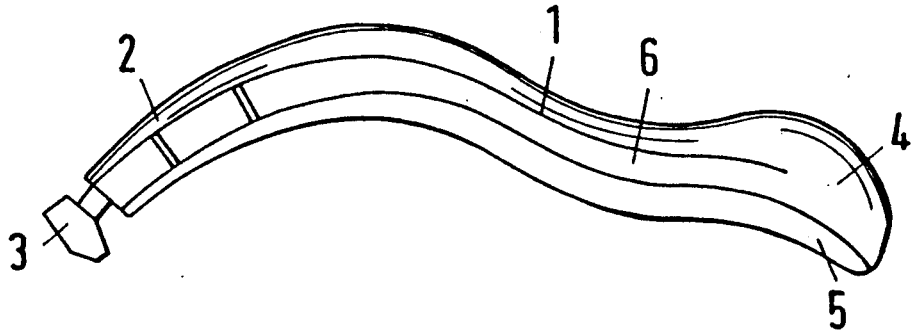
FIG. 3 is a side view of a second exemplary embodiment of the inventive wet razor.
Figure 4:
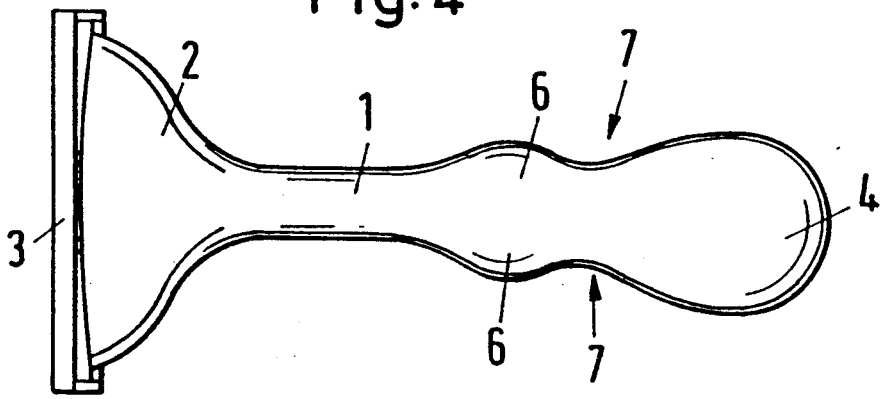
FIG. 4 is a top view of the razor of FIG. 3.

The second embodiment illustrated in FIGS. 3 and 4 also shows a wet razor whose handle 1 has an essentially S-shaped curved configuration in the manner of a swan's neck. Also in this embodiment the rear end of the handle 1 has a tongue-like widened portion 4 with a flattened portion 5 on the underside. However, in contrast to the embodiment of FIGS. 1 and 2, this embodiment is additionally provided with lateral widened portions 6 in the region between the rear, tongue-like widened portion 4 and the forward razor head 2, as can be seen from the top view of FIG. 4. These lateral widened portions 6, together with the rear, tongue-like widened portion 4, form gripping recesses or indentations 7.

Figure 5:
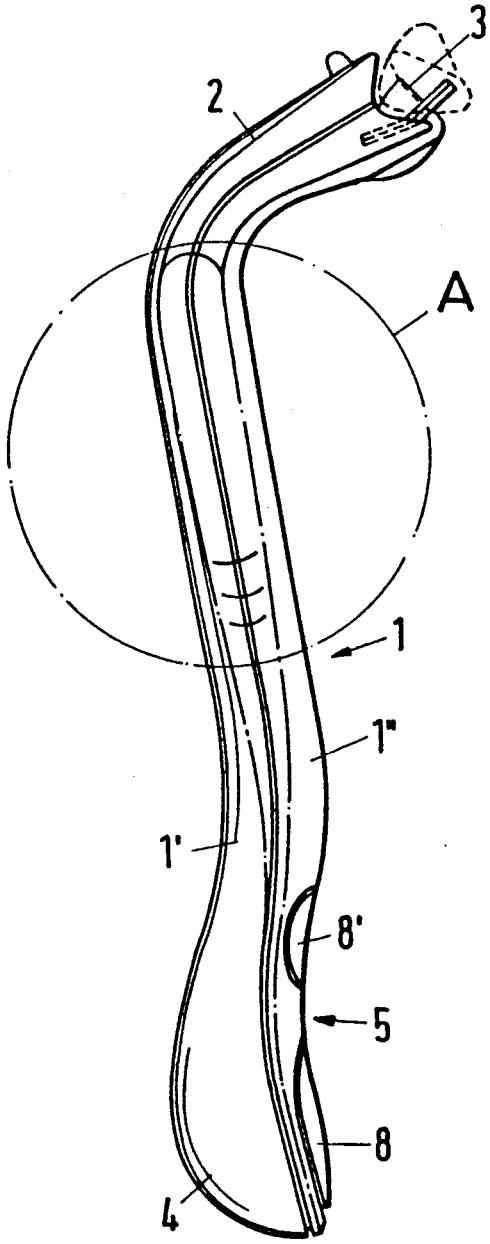
FIG. 5 is a side view of a third exemplary embodiment of the inventive wet razor.
Figure 6:
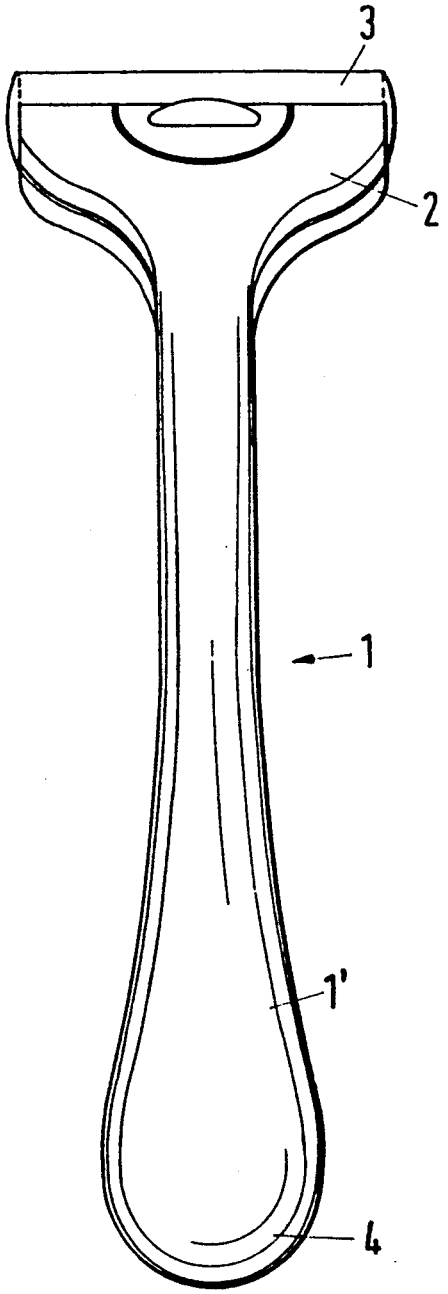
FIG. 6 is a top view of the razor of FIG. 5.
Figure 7:
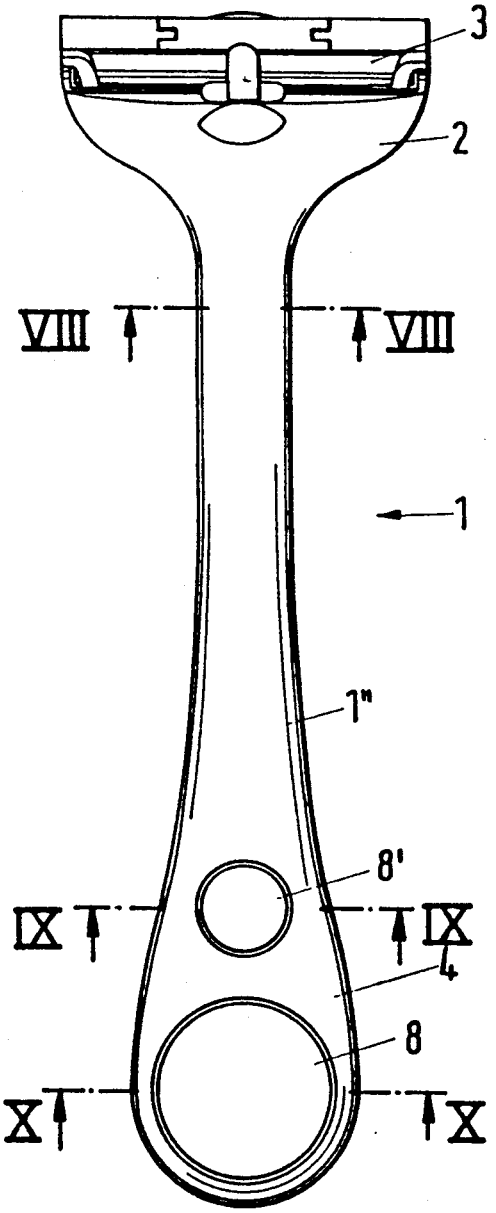
FIG. 7 is a bottom view of the razor of FIGS. 5 and 6.

Finally, the third embodiment illustrated in FIGS. 5 to 1O also shows a wet razor whose handle has an essentially S-shaped curved configuration, with the curve shape corresponding essentially to that of the first embodiment of FIGS. 1 and 2. Here also the rear end of the handle 1 is provided with a tongue-like widened portion 4 that has a flattened portion 5 on the underside.

In contrast to the two previous embodiments, with this embodiment the handle 1 comprises two interconnected molded parts, one of which forms a half-shell-like upper portion 1' of the handle 1, while the other of which forms a half-shell-like lower portion 1" of the handle. This can be seen particularly clearly from the cross-sectional views of FIGS. 8 to 1O. The two molded parts can be interconnected in a conventional manner, for example via a frictional connection.

Figure 8:
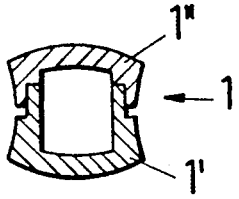
FIG. 8 is a cross-sectional view taken along the line VIII—VIII in FIG. 7.
Figure 9:
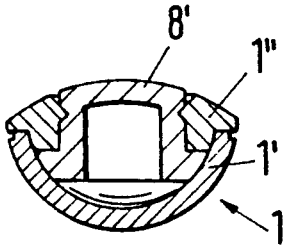
FIG. 9 is a cross-sectional view taken along the line IX—IX in FIG. 7.
Figure 10:
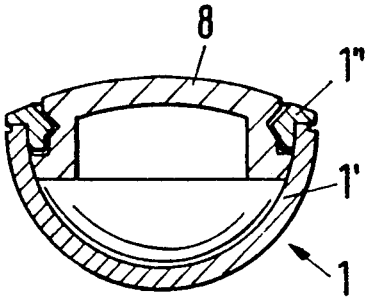

The cross-sectional view of FIG. 8 furthermore shows that in the region A between the rear, tongue-like widened portion 4 and the front razor head 2, the longitudinal sides have a concavely curved cross-sectional configuration and form a type of longitudinal recess or indentation, the configuration and purpose of which were already described previously.

A significant difference between the previously described embodiments and this third embodiment is a fact that in the region of the flattened portion 5 of the tongue-like widened portion 4, this third embodiment is provided with padding means 8, 8' of a soft, flexible material, such as rubber or plastic. These padding means 8, 8' are round and have different diameters, with the padding means 8 at the rear end having a larger diameter than does the padding means 8', which is disposed closer to the razor head 2. The padding means 8, 8' are cap-like molded parts that are inserted into the handle in an interlocking manner. In so doing, a continuous transition results between the surface of the flattened portion 5 and the surface of the padding means 8, 8'; in other words, the padding means 8, 8' fit harmonically into the handle 1. The padding means 8, 8' form rest or contact surfaces for the finger tips of the user during a shaving process, and in so doing are pressed slightly inwardly. As a result, gripping recesses or indentations are formed.

In all of the illustrated embodiments, the handle 1 of the respective wet razor has an optimally ergonomic shape that ensures an optimum handling for the user. The inherent result of this is an optimum shaving result, since due to the curved configuration of the handle with the tongue-like widened portion at the rear end with its flattened portion underneath, the user can reliably and securely grip the handle. Due to the S shape, a saddle is formed on the back of the handle for reliably receiving the front portion of the hand surface during shaving.

Thus, the handle optimally conforms to the closed hand, with the tongue-like widened portion coming to rest in the closed fist of the user and thus providing a large support surface within the hand, which on the whole improves the overall stability of the system hand/wet razor.

The present invention is, of course, in no way restricted to the specific disclosure of the specification and drawings, but also encompasses any modifications within the scope of the appended claims.

What we claim is:

1. In a wet razor having a handle, at the front end of which a razor blade unit is disposed on a razor head, with said handle having a central longitudinal plane that has an essentially S-shaped curved configuration, wherebY the rear end of said handle is provided with a tongue-like widened portion, the improvement wherein:

in a region of said handle disposed between said razor head and said tongue-like widened portion, said handle has sides having a contour with a concave cross-sectional configuration, while upper and lower surfaces of said handle, 90° from said sides thereof, have a contour with a convex cross-sectional configuration.

2. A wet razor according to claim 1, in which said concavely inwardly curved sides of said handle form an elongated ergonomic gripping indentation for the thumb and middle finger of a user.

3. A wet razor according to claim 1, in which on a longitudinal underside of said handle, said tongue-like widened portion is provided with a flattened portion.

4. A wet razor according to claim 3, in which said flattened portion is provided with at least one padding means of flexible material, said padding means having an outer surface that is essentially flush with an outer surface of said flattened portion.

5. A wet razor according to claim 4, in which said flattened portion is provided with two padding means that in a longitudinal direction of said handle are disposed one after the other, with that padding means that is disposed closer to said razor head being smaller than the other of said padding means.

6. A wet razor according to claim 4, in which said padding means has a round shape.

7. A wet razor according to claim 1, in which in a region between said forward razor head and said rear tongue-like widened portion, each of said sides of said handle is provided with a respective lateral widened portion that extends transverse to a longitudinal central axis of said handle, with gripping indentations being formed on said handle between said lateral widened portions and said rear tongue-like widened portion.

8. A wet razor according to claim 1, in which said handle comprises two interconnected molded parts that form an upper portion and a lower portion of said handle respectively.

9. A wet razor according to claim 1, which has a center of gravity that is disposed in the region between a forward third of said handle and the halfway point thereof.

* * * * *